US005449160A

United States Patent [19]

Hou et al.

[11] Patent Number: 5,449,160

[45] Date of Patent: Sep. 12, 1995

[54] GATELESS ROCKER INVERTER

[75] Inventors: Ssujan Hou, Webster; Lam F. Wong, Fairport; Lisbeth S. Quesnel, Pittsford; Paul J. DeGruchy, Hilton, all of N.Y.

[73] Assignee: Xerox Corporation, Stamford, Conn.

[21] Appl. No.: 282,342

[22] Filed: Jul. 29, 1994

[51] Int. Cl.[6] ..... B65H 5/00; B65H 29/00

[52] U.S. Cl. ..... 271/3.15; 271/184; 271/186; 271/902; 271/9.02; 355/319

[58] Field of Search ..... 271/184, 185, 186, 902, 271/3, 9; 355/318, 319

[56] References Cited

U.S. PATENT DOCUMENTS

| | | | |
|---|---|---|---|
| 3,360,099 | 12/1967 | Barr | 271/184 |
| 4,359,217 | 11/1982 | Roller et al. | 271/186 |
| 4,836,525 | 6/1989 | Mizuno | 271/186 |
| 5,132,742 | 7/1992 | Goto | 355/319 |

*Primary Examiner*—H. Grant Skaggs

*Attorney, Agent, or Firm*—William A. Henry, II

[57] ABSTRACT

A gateless rocker inverter for reversing the lead and trail edges of a sheet includes two idler roll and drive roll nip pairs with the drive rolls continuously rotating in opposite directions. The idler rolls are attached to two ends of a coupler of a four-bar linkage which opens and closes the nips in sequence, first to drive the sheet forward and subsequently to drive the sheet in a reverse direction out of the inverter for duplexing purposes.

10 Claims, 4 Drawing Sheets

GATELESS ROCKER INVERTER

BACKGROUND OF THE INVENTION

This invention relates to an apparatus for exchanging lead and trail edges of sheets, and more particularly, to an improved gateless rocker sheet inverting inverter apparatus that alternately engages sheets with two roller nips in order to drive sheets in opposite directions.

Although a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead and trail edge orientation of the sheet. In typical inverters, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may or may not also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain or change the sheet orientation.

In the field of reprographic machines, it is often necessary to feed a copy sheet leaving the processor of the machine along one of two alternate paths, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feed it back into the processor, but inverted, so that the appropriate data can be applied to the second side of the sheet. One known sheet-feeder (U.S. Pat. No. 4,359,217) for effecting this includes three rollers in frictional or geared contact with each other, to provide two spaced-apart nips, one being an input nip to an associated downstream sheet pocket, and the other being an output nip for extracting each sheet from the pocket.

The present invention aims at providing an inverter designed to have a sheet to be duplexed fed to it, stopped momentarily, and fed back to a processor for imaging onto the opposite side. The inverter includes two nip pairs with drive rolls continuously rotating. Idler rolls that mate with the drive rolls to form the two nips are adapted to swing between engagement and disengagement positions with one nip set moving a sheet in a forward direction and the other nip set moving the sheet in a reverse direction.

SUMMARY OF THE INVENTION

Accordingly, the present invention provides a gateless rocker inverter configuration that enables duplex printing in copier/printers by use of a first drive roll and a first idler roll forming a first nip for driving sheets in an incoming direction into the inverter; a second drive roll and a second idler roll forming a second nip pair for reversing the sheets and driving them in a direction opposite to the incoming direction and out of the inverter; a linkage mechanism connecting said first and second idler rolls for engagement and disengagement with said first and second drive rolls; a sensor adapted to sense the trail edge of a sheet and provide a signal; and a controller adapted to receive said signal from said sensor and disengage said first nip pair and engage said second nip pair in order to exchange lead and trail edges of the sheets and drive them out of the inverter for copying onto the opposite sides of the sheets.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the inverter system of the present invention for a copier/printer. However, it should be understood that the sheet inverting method and apparatus of the present invention could be used with any machine in which inversion of a sheet is desired, be that sheet stacking or duplexing.

In general, an improvement to prior sheet inverter systems of machines is disclosed which is cost effective and comprises the use of a gateless rocker inverter configuration.

Figure 1:
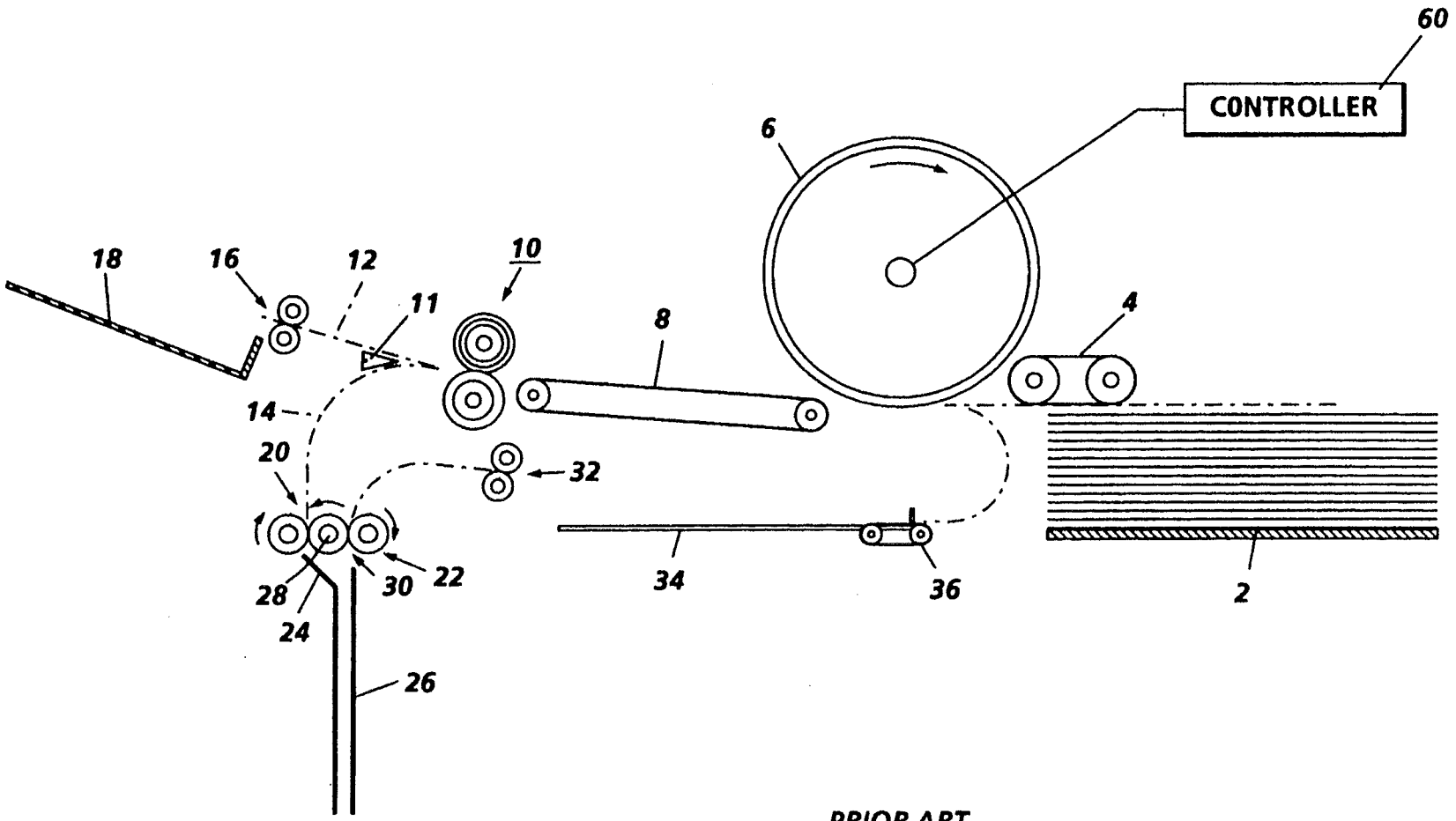
PRIOR ART FIG. 1
FIG. 1 is a schematic of a printing apparatus employing a conventional inverter.

The prior art apparatus shown in FIG. 1 consists basically of means for holding a stack 2 of copy sheets adjacent to a feeder 4 for extracting a sheet from the top of the stack each time a copy is required. Each sheet leaving feeder 4 passes in non-sliding contact with a photoreceptor 6 (shown here in the form of a drum, although it could equally be a belt), from which a particulate material (toner) designed to present a visual contrast with the material of the sheet is transferred from the surface of the photoreceptor to the upper face of the respective sheet. After the sheet with the toner image held on it by electrostatic attraction has been detached from the photoreceptor 6, it is conveyed by a conveyor 8 to a fuser 10, which fuses the toner into a permanent bond with the material forming the sheet, by the application of heat and/or pressure.

On leaving the fuser, the sheet contacts a diverter 11 which deflects the sheet so that it moves along one of two paths 12 and 14. Path 12 is an output path, which leads to a sheet conveying nip 16 which ejects each finished sheet into an output tray 18. A sheet deflected along path 14 passes to the input nip 20 of tri-roll inverter generally referenced Downstream of nip 20 is an inclined surface 24 leading to a substantially-vertical pocket 26. Although not shown in FIG. 1, the bottom of the pocket has in it known means, such as an aligned series of springs, positioned at a distance from the inverter 22 such that when the lead edge of the sheet being fed by nip 20 comes into contact with the spings etc., the trail edge of the sheet leaves the nip 20. Because of the lateral displacement (as viewed) of the pocket from the nip 20, the sheet being fed into the pocket necessarily has a curve induced in it. The natural resilience of the sheet material is used to flip the freed trail edge of the sheet to the right as viewed, immediately clearing it of the nip 20. The sheet itself has sufficient momentum to deflect the reversing means sufficiently to permit the trail edge of the sheet to move below the bottom of the center roll 28. When the energy stored in the distorted reversing means (springs) is released, it is expended on reversing the direction of the momentum of the sheet, and force the former trail edge of the sheet to become a new lead edge, which is forced into the other nip 30 of the inverter 22. The nip thus functions to extract the sheet from the pocket 26, and pass it through a sheet transport nip 32 into a buffer tray 34, which is sometimes also known as a dedicated duplex tray. With orientation as viewed, it will be seen that the face of the sheet having the first copy applied to it will be uppermost in tray 34. Each sheet in tray 34 is engaged by a bottom mounted feeder 36 which is effective to extract the sheet from the tray 34 and turn it through a sufficient angle for its remaining blank side to come into contact with the photoreceptor 6, and for the process to be repeated. Matters are arranged that when the resultant duplex copy sheet leaves fuser 10, it is passed directly to output tray 18, without being redirected towards inverter 22.

Figure 2:
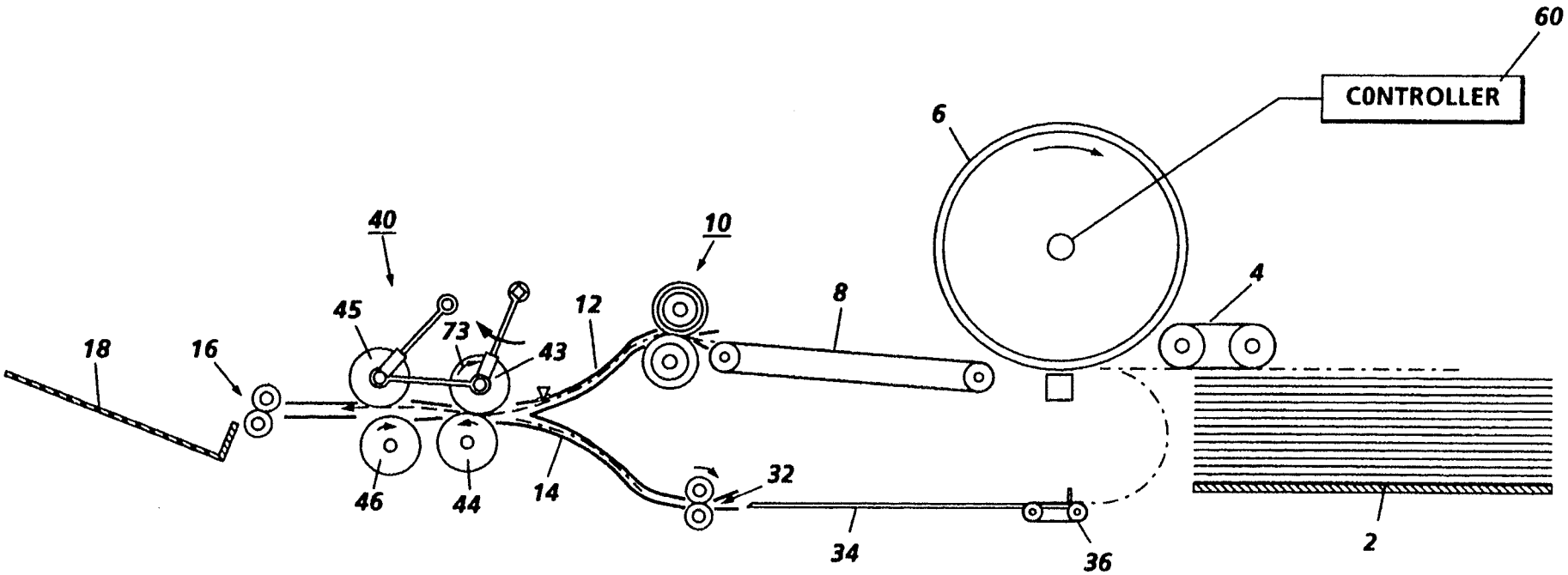
FIG. 2 is a schematic of the printing apparatus of FIG. 1 incorporating the inverter apparatus of the present invention therein.
Figure 4:
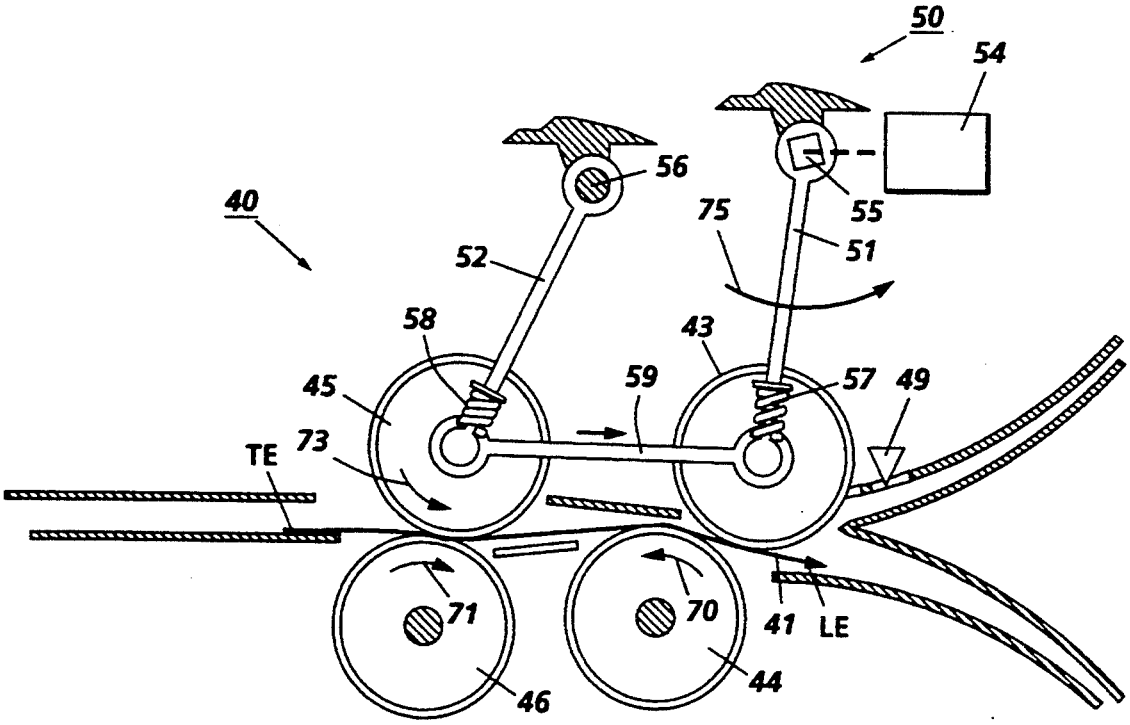
FIG. 4 is a partial schematic of the inverter of FIG. 2 showing an outgoing nip closed for feeding a sheet out of the inverter.
Figure 5:
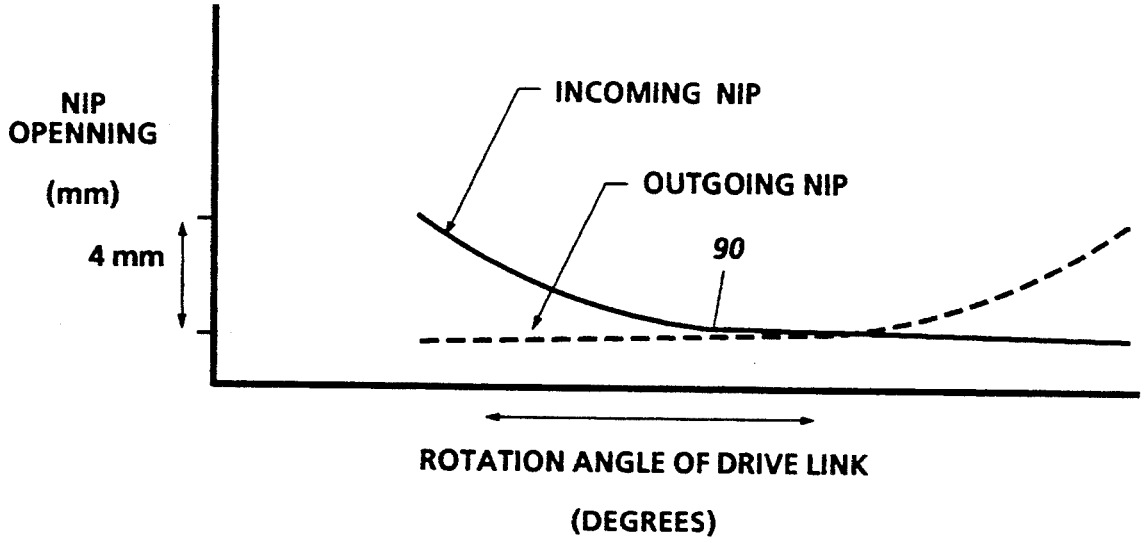
FIG. 5 is a chart showing a plot of the nip opening versus the rotation angle of the drive link.

With the inverter apparatus 40 of the present invention, as shown in FIG. 2, replacing the inverter 22 of FIG. 1, copy sheets are fed to buffer tray 34. However, buffer tray 34 could be eliminated and trayless duplexing employed with sheets being transported directly to photoreceptor 6, if desired. Inverter 40 in FIGS. 3 and 4, comprises an idler roll 43 that forms an incoming sheet driving nip with drive roll 44 and is driven in the direction of arrow 72 by drive roll 44 to drive sheets into inverter 40. An outgoing nip for driving sheets out of the inverter in a direction opposite to their incoming direction is formed between idler roll 45 and drive roll 46. Idler roll 45 of the outgoing nip is driven by reversing drive roll 46 in the direction of arrow 73. Idler rolls 43 and 45 are attached to the ends of a coupler member 59 of a four-bar linkage 50 that includes pivotably mounted bars 51 and 52. Springs 57 and 58 which are mounted on bars 51 and 52, respectively, of four-bar linkage 50, bias idlers 43 and in a direction toward drive rolls 44 and 46 and enhances the range of sheet weights that can be manipulated within the inverter. The four-bar linkage pivots about shafts 55 and 56 shown in FIGS. 3 and 4. A conventional drive link 54, such as, a geared shaft and a stepper motor, under control of controller 60 drives the four-bar linkage alternately in the direction of arrows 74, and 75 to its two engagement positions. A sensor 49 is positioned upstream of the nip formed between idler roll 43 and drive roll 44 and is adapted to give off a signal indicating passage of the trail edge of each sheet when duplexing is required. Drive rolls 44 and 46 are rotating continuously in opposite directions of arrows 70 and 71 when the machine is ON and controller 60 processes the signals from sensor 49 to in turn open and close the nips in sequence, first to drive the sheet forward with the first drive rolls nip (43,44) while keeping the reversing rolls nip open, and subsequently, to open the first drive rolls nip (43, 44) and close the second reversing rolls nip (45,46) to move the sheet in the reverse direction while keeping the driving rolls nip open. During this time, the incoming idler roll 43 acts as a gate to guide the sheets out to the paper path. As a result, the sheets are then fed out with a proper exit angle. As seen in FIG. 5, four-bar linkage 50 is designed such that, during transition, there is a very small duration at 90 where both the incoming and outgoing sheet drive nips are closed when the rotation angle of the drive linkage in degrees is plotted against nip openings in millimeters. At least one of the two nips should be closed at all times. If duplex copying is not required, a sheet is simply driven through the inverter and delivered to output tray 18 by sheet transporting nip(s) 16. The paper path between both nips should be kept as close as possible since the reversing nip must drive against the open incoming driver.

When the two-sided printing (copying) option is selected, a copy sheet 41 exiting the fuser 10 enters the inverter 40 lead edge first. The sheet is advanced by a now closed nip formed between idler roll 43 and feed roll 44. Once the trail edge of the sheet passes sensor 49, a conventional drive link mechanism 54 is actuated by controller 60 upon a signal from sensor 49 and pivots bar 51 about pivot point 55. This action opens the incoming drive nip (43,44) and closes outgoing drive nip (45,46) which in turn drives the sheet in a reverse direction out of the inverter and into sheet transporting nip 32 that conveys the sheet to buffer tray 34 for refeeding to photoreceptor 6 and imaging on its opposite side.

Figure 3:
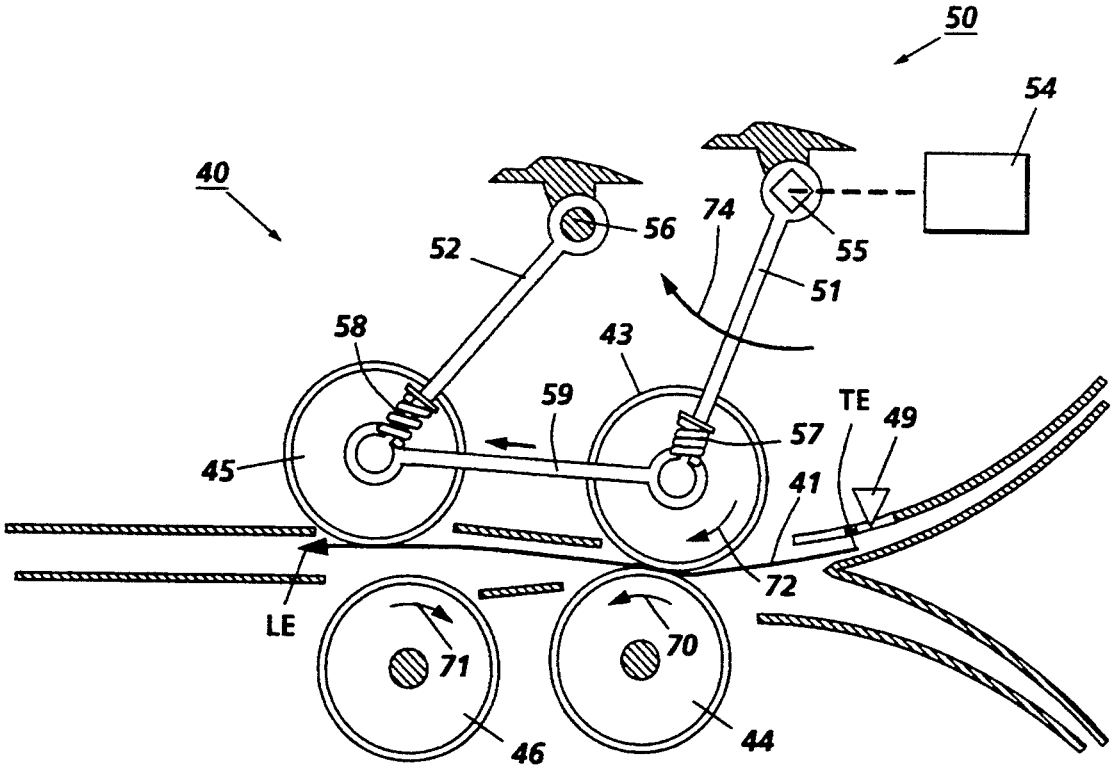
FIG. 3 is a partial schematic of the inverter of FIG. 2 showing an incoming nip closed for feeding a sheet into the inverter.
Figure 6:
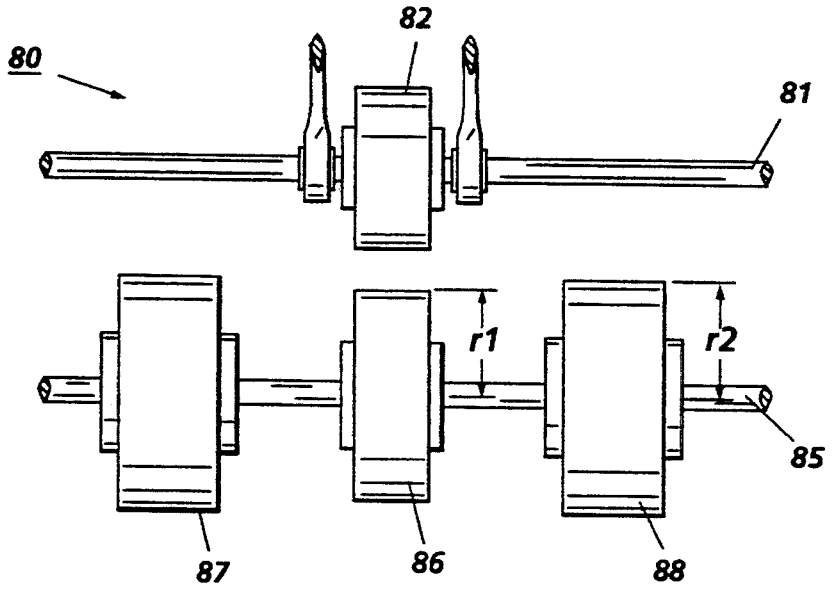
FIG. 6 is a schematic end view of one of two inverter driving nips of an alternative embodiment of the inverter of the present invention.

In FIG. 6, an alternative embodiment of the inverter of the present invention includes an arrangement 80 of one of two inverter drive nips that could replace the input and output nips of inverter 40 in FIG. 3. Arrangement 80 has an idler roll 82 mounted on shaft 81 which in turn is pivotably mounted on a four-bar linkage (not shown) as in FIG. 3. Freely rotating idler rolls 87 and 88 are positioned on opposite sides of drive roll 86 which is rotatably mounted on shaft 85. Idler roll 82 is adapted to be pivoted into engagement with drive roll 86 to form a sheet driving nip. Drive roll 86 rotates continuously on shaft 85 and has a radius $r^1$ that is less than the radius $r^2$ of sandwiching idler rolls 87 and 88. As a result, when the nip is open, a sheet is riding on the idler roll and when the nip is closed, the sheet is driven by the drive roll. With this arrangement, a copy sheet will not have direct contact with drive roll 86 when moving in the opposite direction of the drive roll.

Inverter 40 has several advantages over prior inverters in that: control is simple since there is no direction reversal for the drive rolls, the swing of the drive link controls the driving direction, and the entrance and exit angles; no gates are needed; registration is improved since gradual engagement of a drive nip minimizes the free floating of the sheet; and reliability is improved because the direction of the sheet is controlled by one of the two nips.

As described above in detail, the inverter of the present invention is made up of two nip pairs, each consisting of a drive roll and an idler roll with one of the nip pairs being an incoming sheet nip and the other an outgoing sheet nip. Idler rolls of the nip pairs are attached to two ends of a coupler of a pivotable four-bar linkage mechanism. The driving direction of a sheet is dependent upon the idler engagement with the two drive rolls which are turning continuously in opposite directions. The incoming nip is closed and outgoing nip is open when the drive link swings to the left for a sheet to be fed into the inverter. When the sensor senses the trail edge of the sheet, the drive link swings to the right to close the outgoing nip and open the incoming nip and the sheet is fed back to the photoreceptor for duplexing purposes.

It is, therefore, evident that there has been provided in accordance with the present invention an inverter apparatus for copiers/printers or the like which serves to reverse lead and trail edges of a sheet thereby fully satisfying the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A gateless rocker inverter device, comprising:

a first drive roll and a first idler roll forming a first nip for driving sheets in an incoming direction into the inverter;

a second drive roll and a second idler roll forming a second nip for reversing the sheets and driving them in a direction opposite to the incoming direction and out of the inverter;

a linkage mechanism connecting said first and second idler rolls for engagement and disengagement with said first and second drive rolls;

a sensor adapted to sense the trail edge of a sheet and provide a signal; and a controller adapted to receive said signal from said sensor and disengage said first nip and engage said second nip in order to exchange lead and trail edges of the sheets and drive them out of the inverter for further processing, and wherein said first and second nips are momentarily in engagement with sheets simultaneously.

2. The gateless rocker inverter device of claim 1, wherein said linkage mechanism is a four bar linkage and said idler rolls are coupled to said four bar linkage.

3. The gateless rocker inverter device of claim 1, wherein said first and second drive rolls are constantly driven in opposite directions.

4. A copier/printer including a processing station for processing page image information, a sheet feeder for feeding sheets to the processing station to receive the page image information, a transfer station for transferring the page image information from the processing station to the sheets, a fusing station for fusing the page image information onto the sheets and a gateless rocker inverter device used when printing onto both sides of the sheets is desired, comprising:

a first drive roll and a first idler roll forming a first nip for driving sheets in an incoming direction into the inverter;

a second drive roll and a second idler roll forming a second nip for reversing the sheets and driving them in a direction opposite to the incoming direction and out of the inverter;

a linkage mechanism connecting said first and second idler rolls for engagement and disengagement with said first and second drive rolls;

a sensor adapted to sense the trail edge of a sheet and provide a signal; and a controller adapted to receive said signal from said sensor and disengage said first nip and engage said second nip in order to exchange lead and trail edges of the sheets and drive them out of the inverter for further processing, and wherein said first and second nips are momentarily in engagement with sheets simultaneously.

5. The gateless rocker inverter device of claim 4, wherein said linkage mechanism is a four bar linkage and said idler rolls are coupled to said four bar linkage.

6. The gateless rocker inverter device of claim 4, wherein said first and second drive rolls are constantly driven in opposite directions.

7. A method for inverting sheets, comprising the steps of:

driving a sheet into the inverter with a first drive roll and a first idler roll that forms a first nip pair;

opening a second drive roll and a second idler roll that forms a second nip pair downstream of said first nip pair;

sensing the trail edge of the sheet and providing a signal;

providing a controller adapted to receive said signal from said sensor and disengage said first nip pair and engage said second nip pair in order to exchange lead and trail edges of the sheet and drive it out of the inverter for further processing, and momentarily engaging the sheet with both said first and second nip pairs.

8. A gateless rocker inverter device, comprising:

a first drive roll and a first idler roll forming a first nip for driving sheets in an incoming direction into the inverter;

a second drive roll and a second idler roll forming a second nip for reversing the sheets and driving them in a direction opposite to the incoming direction and out of the inverter, said drive and idler rolls being mounted on rotatable shafts with a pair of idler rolls mounted on adjacent sided of each of said drive rolls, said pair of idler rolls having a greater radius than said drive rolls;

a linkage mechanism connecting said first and second idler rolls for engagement and disengagement with said first and second drive rolls;

a sensor adapted to sense the trail edge of a sheet and provide a signal; and a controller adapted to receive said signal from said sensor and disengage said first nip and engage said second nip in order to exchange lead and trail edges of the sheets and drive them out of the inverter for further processing, and wherein said first and second nips are momentarily in engagement with sheets simultaneously.

9. The gateless rocker inverter device of claim 8, wherein said linkage mechanism is a four bar linkage and said first and second idler rolls are coupled to said four bar linkage.

10. The gateless rocker inverter device of claim 8, wherein said first and second drive rolls are constantly driven in opposite directions.

* * * * *